US010711353B2

(12) United States Patent
Nakatsuka et al.

(10) Patent No.: US 10,711,353 B2
(45) Date of Patent: Jul. 14, 2020

(54) PICKLING DEVICE AND PICKLING PAUSE OPERATION METHOD

(71) Applicant: PRIMETALS TECHNOLOGIES JAPAN, LTD., Hiroshima-shi, Hiroshima (JP)

(72) Inventors: Ryusuke Nakatsuka, Hiroshima (JP); Kosei Tsuji, Hiroshima (JP); Hideaki Suemori, Hiroshima (JP); Koichi Nakamura, Hiroshima (JP)

(73) Assignee: PRIMETALS TECHNOLOGIES JAPAN, LTD., Hiroshima-Shi (JP)

( * ) Notice: Subject to any disclaimer, the term of this patent is extended or adjusted under 35 U.S.C. 154(b) by 58 days.

(21) Appl. No.: 15/756,699

(22) PCT Filed: Feb. 22, 2017

(86) PCT No.: PCT/JP2017/006557
§ 371 (c)(1),
(2) Date: Mar. 1, 2018

(87) PCT Pub. No.: WO2017/187737
PCT Pub. Date: Nov. 2, 2017

(65) Prior Publication Data

US 2018/0312982 A1 Nov. 1, 2018

(30) Foreign Application Priority Data

Apr. 27, 2016 (JP) ..... 2016-089229

(51) Int. Cl.
*C23G 3/02* (2006.01)
*C23G 1/08* (2006.01)

(52) U.S. Cl.
CPC ..... *C23G 3/021* (2013.01); *C23G 1/08* (2013.01); *C23G 3/025* (2013.01)

(58) Field of Classification Search
CPC ..... C23G 3/021; C23G 3/025; C23G 1/08
(Continued)

(56) References Cited

U.S. PATENT DOCUMENTS 5,248,372 A 9/1993 McNamee
5,803,981 A 9/1998 Lordo
(Continued)

FOREIGN PATENT DOCUMENTS

JP 50-145712 A 12/1975
JP 61-102308 U 6/1986
(Continued)

OTHER PUBLICATIONS

Office Action dated Feb. 26, 2019 issued in corresponding Japanese Application No. 2016-089229 with an English Translation.
(Continued)

*Primary Examiner* — Tinsae B Ayalew
(74) *Attorney, Agent, or Firm* — Birch Stewart, Kolasch & Birch, LLP

(57) ABSTRACT

To prevent over-pickling of a steel strip during pickling pause, and shorten the time required to switch between pickling operation and pickling pause, a pickling device includes: a pickling tank for storing acid solution and for pickling a steel strip by allowing the steel strip to travel therethrough while the steel strip is immersed in the acid solution; a heat exchanger for heating the acid solution in the pickling tank; a circulation tank for storing the acid solution, provided separately from the pickling tank; an acid-solution circulation unit configured to circulate the acid solution between the pickling tank and the acid-solution storage tank; and a control device configured to control the acid-solution circulation device to maintain a liquid level of the acid solution in the pickling tank at a level below a traveling height of the steel strip.

5 Claims, 5 Drawing Sheets

(58) Field of Classification Search
USPC ..... 134/105
See application file for complete search history.

(56) References Cited

U.S. PATENT DOCUMENTS

| | | | |
|---|---|---|---|
| 6,340,028 | B1 | 1/2002 | Hirai et al. |
| 2014/0165686 | A1 | 6/2014 | Ukolowicz et al. |

FOREIGN PATENT DOCUMENTS

| | | | |
|---|---|---|---|
| JP | 61-129871 | U | 8/1986 |
| JP | 61-210195 | A | 9/1986 |
| JP | 2-133589 | A | 5/1990 |
| JP | 2-41170 | Y2 | 11/1990 |
| JP | 5-195269 | A | 8/1993 |
| JP | 2000-282271 | A | 10/2000 |
| JP | 3160300 | B2 | 2/2001 |
| JP | 2003-213466 | A | 7/2003 |
| JP | 2003-286593 | A | 10/2003 |
| JP | 2004-91856 | A | 3/2004 |
| JP | 2006-307240 | A | 11/2006 |

OTHER PUBLICATIONS

English Translation of the Written Opinion of the ISA dated Apr. 20, 2018 in corresponding International (PCT) Application No. PCT/JP2017/006557.
International Search Report of PCT/JP2017/006557 dated Apr. 4, 2017.
Extended European Seach Report issued to corresponding EP Application No. 17789026.6.
Japanese Office Action for Japanese Application No. 2016-089229, dated May 28, 2019, with English translation.

PICKLING DEVICE AND PICKLING PAUSE OPERATION METHOD

TECHNICAL FIELD

The present invention relates to a pickling device and a pickling pause operation method of the same.

BACKGROUND ART

A pickling device is a device for cleaning and removing oxidized scales, which are oxidized matter formed on a surface of a steel strip such as a cold-rolled steel plate and a hot-rolled steel plate, by causing the oxidized scales to react with acid solution such as hydrochloric acid and sulfuric acid. In a general pickling device, as a steel strip is fed continuously into a pickling tank, acid solution is sprayed onto the steel strip, or the steel strip is immersed in acid solution stored in the pickling tank, and thereby oxidized scales on the surface of the steel strip are removed continuously.

Patent Document 1 discloses a pickling device including: a pickling tank including an acid-solution receiving tank having a shape that is elongated in the traveling direction of a steel strip and is shallow in the middle with respect to the longitudinal direction and deep at both of the inlet and outlet end portions, and a tank lid covering the acid-solution receiving tank; skids disposed on the tank bottom at both sides of the middle part of the acid-solution receiving tank; a plurality of support rolls disposed between the skids; an acid-solution feeding header which injects acid solution onto the steel strip supported by the support rolls; a circulation tank connected to the acid-solution feeding header via an acid-solution feeding line and connected to the acid-solution receiving tank via a return line; and a heat exchanger disposed in the acid-solution feeding line, wherein the acid-solution feeding header injects acid solution to the steel strip to perform continuous pickling.

Patent Document 2 discloses a pickling device including: a pickling tank filled with acid solution; a lid covering an upper part of the pickling tank; an immersion guide roll disposed rotatably on the lower surface of the lid; a support block disposed on the bottom surface of the pickling tank; a bottom plate disposed on an upper part of the support block; and a skid disposed on the upper surface of the bottom plate to face the immersion guide roll, wherein the pickling device performs pickling of a steel strip by causing the steel strip to travel through the acid solution while guiding the steel strip with the immersion guide roll and the skid.

CITATION LIST

Patent Literature

Patent Document 1: JP2004-91856A
Patent Document 2: JP3160300B

SUMMARY

Problems to be Solved

Meanwhile, in a facility with a pickling device, travel of a steel strip may be stopped temporarily (e.g. from a couple of hours to one day), for maintenance or the like of a device disposed upstream or downstream of the pickling device with respect to the traveling direction of the steel strip. At this time, stopping travel of the steel strip while the steel strip is immersed in the acid solution of the pickling tank leads to further progression of pickling of the steel strip, which causes over-pickling. Thus, in a typical case, the acid solution in the pickling tank is transferred to a circulation tank provided separately from the pickling tank, or the steel strip is lifted above the acid solution.

The pickling device disclosed in Patent Document 1 is capable of transferring the acid solution in the pickling tank to the circulation tank during pickling pause to prevent over-pickling of a steel strip, and heating the acid solution with a heat exchanger during pickling operation. However, the temperature of the acid solution decreases with duration of pickling pause, and long time is required to switch from pickling pause to pickling operation.

The pickling device disclosed in Patent Document 2 needs to lift not only the steel strip but also the immersion guide roll, the skid, and the like by using a lifting device, in order to prevent over-pickling of the steel strip during pickling pause. Thus, the lifting device needs to be a large device with a high strength, which may increase the apparatus cost. One may consider transferring the acid solution inside the pickling tank to a circulation tank provided separately from the pickling tank. However, the volume of acid solution is high, and the temperature of the acid solution decreases with duration of pickling pause, which may require long time to switch from pickling pause to pickling operation.

In view of the above, the present invention was made to solve the above described problem. An object of the present invention is to provide a pickling device capable of preventing over-pickling of a steel strip during pickling pause and reducing the switching time between pickling operation and pickling pause, and a method of operating the pickling device during pickling pause.

Solution to the Problems

According to the present invention for solving the above problem, a pickling device includes: a pickling tank for storing acid solution and for pickling a steel strip by allowing the steel strip to travel therethrough while the steel strip is immersed in the acid solution; a heating unit for heating the acid solution in the pickling tank; an acid-solution storage tank for storing the acid solution, provided separately from the pickling tank; an acid-solution circulation unit configured to circulate the acid solution between the pickling tank and the acid-solution storage tank; and a liquid level adjustment unit configured to control the acid-solution circulation unit to maintain a liquid level of the acid solution in the pickling tank at a level below a traveling height of the steel strip.

According to the present invention for solving the above problem, a method of operating, during pickling pause, a pickling device which includes: a pickling tank for pickling a steel strip by allowing the steel strip to travel therethrough while the steel strip is immersed in acid solution; a heating unit for heating the acid solution in the pickling tank; and a circulation unit configured to circulate the acid solution between an acid-solution storage tank for storing the acid solution and the pickling tank, includes: during pickling pause of the steel strip, circulating the acid solution between the acid-solution storage tank and the pickling tank with the acid-solution circulation unit while maintaining a liquid level of the acid solution inside the pickling tank at a level below a traveling height of the steel strip, and heating the circulating acid solution with the heating unit inside the pickling tank.

Advantageous Effects

According to the present embodiment, during pickling pause of a steel strip, the acid solution circulates between the pickling tank and the acid-solution storage tank while the liquid level of the acid solution inside the pickling tank is maintained to be below the traveling height of the steel strip, and thereby it is possible to prevent over-pickling of the steel strip during pickling pause. Furthermore, the acid solution is heated by the heating unit to the predetermined temperature and is circulated between the pickling tank and the acid-solution storage tank with the acid-solution circulation unit. Thus, as compared to a case in which the entire acid solution is discharged from the pickling tank and stored in a tank separate from the pickling tank, it is possible shorten the time required to switch between pickling operation and pickling pause.

DETAILED DESCRIPTION

Hereinafter, embodiments of a pickling device and a method of operating the pickling device during pickling pause according to the present invention will be described with reference to the drawings. Nevertheless, the present invention should not be limited only to the following embodiments.

First Embodiment

Figure 1:
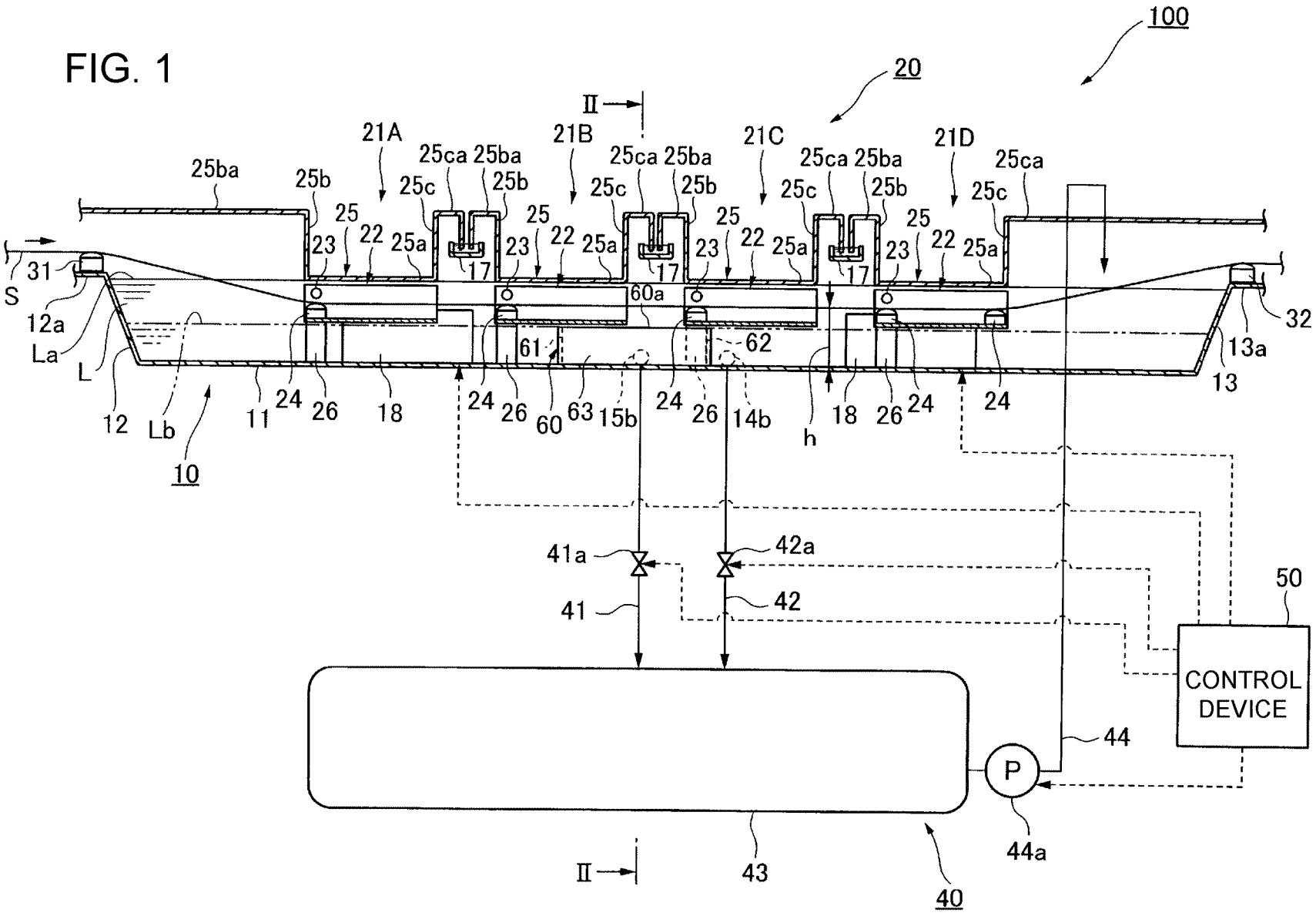
FIG. 1 is schematic side view of a pickling device according to the first embodiment of the present invention.
Figure 2:
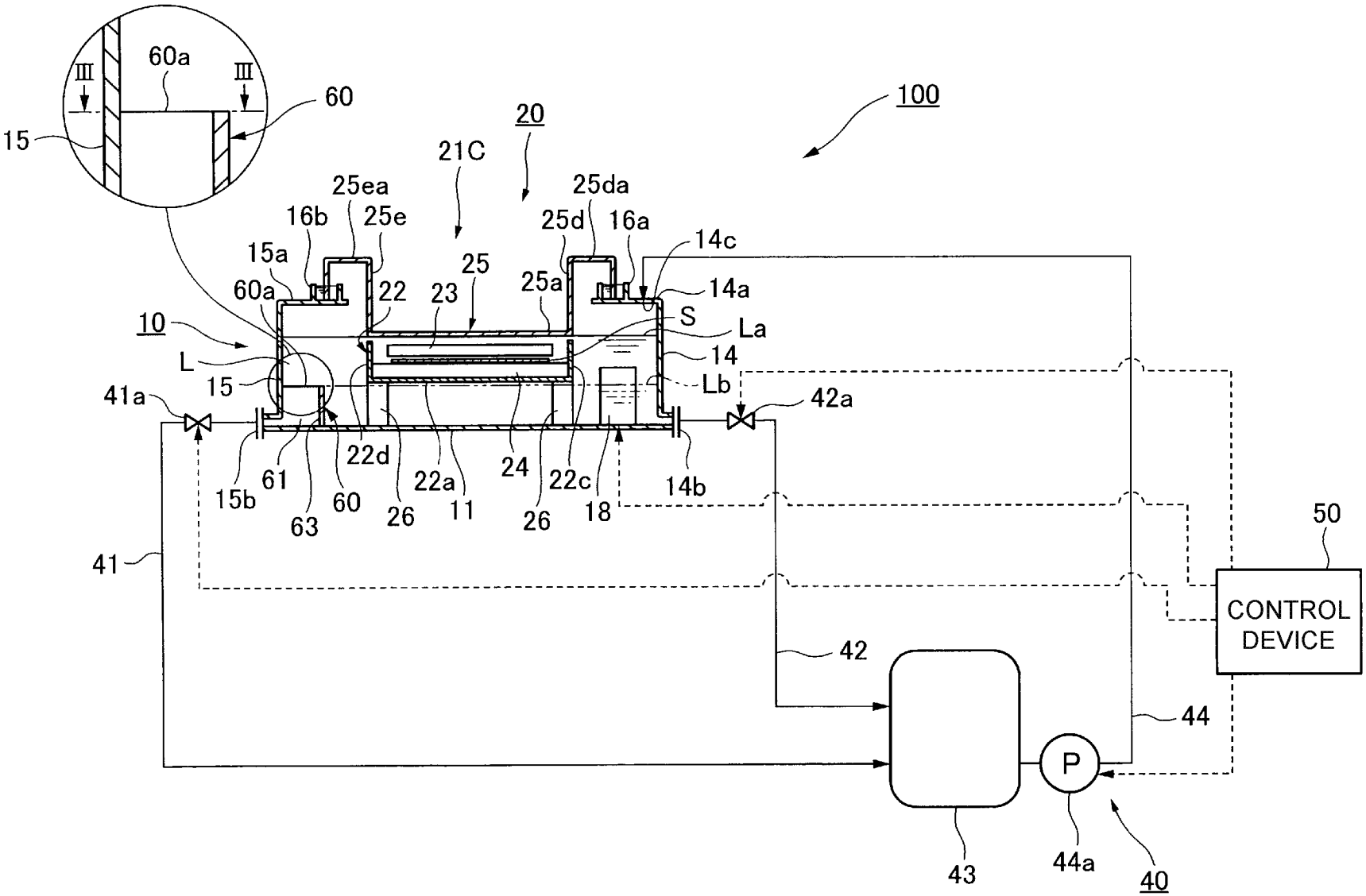
FIG. 2 is a cross-sectional view taken along line II-II in FIG. 1.
Figure 3:
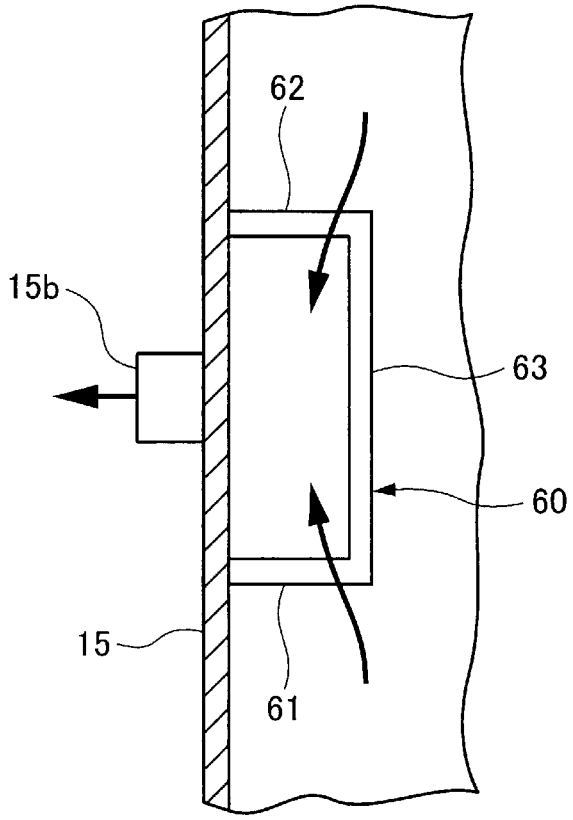
FIG. 3 is a cross-sectional view taken along line in FIG. 2.

With reference to FIGS. 1, 2, and 3, the pickling device according to the first embodiment of the present invention will now be described.

As shown in FIGS. 1 and 2, a pickling device 100 according to the present embodiment includes a pickling tank 10, a circulation tank (acid-solution storage tank) 43, an acid-solution circulation device (acid-solution circulation unit) 40, and a control device (liquid level adjustment unit) 50.

The pickling tank 10 is a deep tank. The pickling tank 10 includes: a tank body having a bottom plate 11, a front plate 12, a rear plate 13, a right plate 14, and a left plate 15, which is open at the top, and is capable of storing acid solution L; and a plurality of (four in the illustrated example) cover members 25 covering the opening of the tank body. The bottom plate 11 extends in the traveling direction (feeding direction) of a steel strip S, and is inclined such that the bottom plate 11 reaches its lowermost point at the first drain port 15*b* (central circulation port) described below in detail. The front plate 12, the rear plate 13, the right plate 14, and the left plate 15 form vertical walls of the pickling tank 10. It should be noted that the pickling tank 10 and the cover members 25 may be made of an acid-resistant material such as a resin like polypropylene and a composite containing the same, or of a steel can member with rubber lining, further covered with acid-resistant bricks.

The front plate 12 is connected to a front end portion of the bottom plate 11, disposed on the upstream side with respect to the traveling direction of the steel strip S. The rear plate 13 is connected to a rear end portion of the bottom plate 11, disposed on the downstream side with respect to the traveling direction of the steel strip S. The right plate 14 is connected to the right end portion of the bottom plate 11 with respect to the width direction, entirely in the traveling direction of the steel strip S. The upstream end portion and the downstream end portion of the right plate 14, with respect to the traveling direction of the steel strip S, are connected to the front plate 12 and the rear plate 13. The left plate 15 is connected to the left end portion of the bottom plate 11 with respect to the width direction, entirely in the traveling direction of the steel strip S. The upstream end portion and the downstream end portion of the left plate 15, with respect to the traveling direction of the steel strip S, are connected to the front plate 12 and the rear plate 13.

The left plate 15 and the right plate 14 have the first drain port 15*b* and the second drain port 14*b* formed thereon, respectively, in the middle and at the lower side with respect to the traveling direction of the steel strip S.

On the upper end portion side of the front plate 12, a front flange portion 12*a* is formed so as to extend horizontally upstream in the traveling direction of the steel strip S. On the upper end portion side of the rear plate 13, a rear flange portion 13*a* is formed so as to extend horizontally downstream in the traveling direction of the steel strip S. An inlet skid 31 is disposed on the front flange portion 12*a*, and an outlet skid 32 is disposed on the rear flange portion 13*a*.

On the upper end portion side of the right plate 14 and the left plate 15, a right flange portion 14*a* and a left flange portion 15*a* are formed, respectively, so as to extend inward in the width direction of the pickling tank 10. A right receiving portion 16*a* is disposed on the right flange portion 14*a*, and a left receiving portion 16*b* is disposed on the left flange portion 15*a*. The right receiving portion 16*a* and the left receiving portion 16*b* are both filled with seal solution, such that end portions of the right plates 25*d* and the left plates 25*e* of the cover members 25 are immersed in the seal solution. Accordingly, the upper sides of both end portions of the pickling tank 10, with respect to the width direction, are sealed with the cover members 25.

A plurality of (three in the illustrated example) width-directional receiving portions 17 are disposed to connect the right plate 14 and the left plate 15 so as to form a shape that extends in the width direction of the pickling tank 10. The plurality of width-directional receiving portions 17 are arranged next to one another in the traveling direction of the steel strip S.

The plurality of width-directional receiving portions 17 are disposed between guide device bodies (described below) arranged next to one another in the traveling direction of the steel strip S. The width-directional receiving portions 17 are filled with seal solution, such that end portions of the front plates 25*b* and the rear plates 25*c* of the cover members 25 are immersed in the seal solution. Accordingly, the upper sides between the guide device bodies, arranged next to one another with respect to the traveling direction of the steel strip S in the pickling tank 10, are sealed with the cover members 25.

The pickling tank 10 includes a plurality (two in the illustrated example) heat exchangers (heating units). The plurality of heat exchangers 18 are arranged next to one another in the traveling direction of the steel strip S. The heat exchangers 18 are disposed on the bottom plate 11 of the pickling tank 10, under the right flange portion 14*a* and in the vicinity of the right plate 14. The heat exchangers 18 are substantially flush with the traveling height h of the steel strip S. Furthermore, the heat exchangers 18 are each a heat-transfer tube which is arranged to extend in the height direction and the side-plate width direction, and which has a function of indirect heating through supply of a heat medium (e.g. steam) into the tube. Thus, with at least a part of the heat exchangers 18 being immersed in the acid solution L in the pickling tank 10, it is possible to heat the acid solution L in the pickling tank 10 to a predetermined temperature.

The pickling tank 10 includes a guide device (steel strip guide device) 20 for guiding the steel strip S. The guide device 20 includes a plurality of (four in the illustrated example) guide device bodies 21A to 21D. The plurality of guide device bodies 21A to 21D are arranged next to one another in the traveling direction of the steel strip S. The guide device bodies 21A to 21D each includes a gutter-shaped member (immersion box) 22 having a U-shaped lateral cross section, an immersion guide roll 23, a skid 24, and a support block 26.

The gutter-shaped member 22 has a shape that extends in the traveling direction of the steel strip S and has openings on the upstream side and the downstream side with respect to the traveling direction of the steel strip S. The gutter-shaped member 22 has a bottom plate portion 22*a*, a right plate portion 22*c*, and a left plate portion 22*d*. The right plate portion 22*c* and the left plate portion 22*d* are disposed so as to face each other. An end portion of the bottom plate portion 22*a* (an end portion with respect to the width direction of the steel strip S) and the other end portion of the bottom plate portion 22*a* (the other end portion with respect to the width direction of the steel strip S) are connected to the right plate portion 22*c* and the left plate portion 22*d* entirely in the traveling direction of the steel strip S. The gutter-shaped member 22 is supported by the support block 26.

The skid 24 is disposed on the front end portion side of the bottom plate portion 22*a*, which forms an upstream end portion with respect to the traveling direction of the steel strip S. In the fourth guide device body 21D disposed downstream with respect to the traveling direction of the steel strip S, the skid 24 is also disposed on the rear end portion side of the bottom plate portion 22*a*, which forms a downstream end portion with respect to the traveling direction of the steel strip S. An immersion guide roll 23 is disposed on the front end portion side of a cover member body 25*a* described below in detail, which forms an upstream end portion with respect to the traveling direction of the steel strip S.

The support block 26 is disposed below the skid 24, on the front end portion side of the bottom plate portion 22*a*, which forms an upstream end portion with respect to the traveling direction of the steel strip S. The support block 26 is disposed on each of both end portions with respect to the width direction of the steel strip S. Accordingly, the guide device bodies 21A to 21D are arranged at a predetermined height inside the pickling tank 10. Thus, during pickling operation for the steel strip S, the pickling tank 10 is filled with acid solution L to the substantially same height as the guide device bodies 21A to 21D, and the steel strip S is guided while being immersed in the acid solution L (at a predetermined traveling height h).

The cover member 25 includes a cover member body 25*a*, a front plate 25*b*, a rear plate 25*c*, a right plate 25*d*, and a left plate 25*e*. The cover member body 25*a* has a plate shape. The cover member body 25*a* is disposed above the gutter-shaped member 22.

The front plate 25*b* has a shape that connects to the front end portion of the cover member body 25*a*, and extends upward. On the upper end portion side of the front plate 25*b*, a front flange portion 25*ba* is formed so as to extend upstream in the traveling direction of the steel strip S. With regard to the cover member 25 arranged corresponding to each of the second to fourth guide device bodies 21B to 21D, a tip end portion of the front flange portion 25*ba* of the front plate 25*b* is bended downward and immersed in seal solution stored in the width-directional receiving portion 17.

The rear plate 25*c* has a shape that connects to the rear end portion of the cover member body 25*a*, and extends upward. On the upper end portion of the rear plate 25*c*, a rear flange portion 25*ca* is formed so as to extend downstream in the traveling direction of the steel strip S. With regard to the cover member 25 arranged corresponding to each of the first to third guide device bodies 21A to 21C, a tip end portion of the rear flange portion 25*ca* of the rear plate 25*c* is bended downward and immersed in the seal solution stored in the width-directional receiving portion 17.

The right plate 25*d* has a shape that connects to the right end portion of the cover member body 25*a*, and extends upward. On the upper end portion side of the right plate 25*d*, a right flange portion 25*da* is formed so as to extend outward in the width direction of the steel strip S. A tip end portion of the right flange portion 25*da* is bended downward and immersed in the seal solution stored in the right receiving portion 16*a*.

The left plate 25*e* has a shape that connects to the left end portion of the cover member body 25*a*, and extends upward. On the upper end portion of the left plate 25*e*, a left flange portion 25*ea* is formed so as to extend outward in the width direction of the steel strip S. A tip end portion of the left flange portion 25*ea* is bended downward and immersed in the seal solution stored in the left receiving portion 16*b*.

Accordingly, the cover members 25 provided corresponding to the first to fourth guide device bodies 21A to 21D cover the pickling tank 10 from above.

The acid-solution circulation device 40 includes a first drain pipe (flow passage for acid solution) 41, a second drain pipe 42, and a supply pipe (return pipe) 44. The first drain pipe 41 has a root end side (an end portion side) connected to the first drain port 15*b* of the pickling tank 10, and a distal end side (the other portion side) connected to the circulation tank 43. An opening-and-closing valve 41*a* is disposed in the first drain pipe 41. The second drain pipe 42 has a root end side connected to the second drain port 14*b* of the pickling tank 10, and a distal end side (the other end portion side) connected to the circulation tank 43. An opening-and-closing valve 42*a* is disposed in the second drain pipe 42. The supply pipe 44 has a root end side (an end portion side) connected to the circulation tank 43, and a distal end side (the other end portion side) connected to the supply port 14*c* of the pickling tank 10. A circulation pump 44*a* is disposed in the supply pipe 44. Preferably, the circulation tank 43 is disposed below the pickling tank 10. In this way, it is possible to drain the acid solution L from the pickling tank 10 into the circulation tank 43 without a pump.

As shown in FIGS. 1 to 3, the pickling device 100 further includes a dam 60 disposed inside the pickling tank 10. The drain port 15*b* is disposed on a lower end of the left plate 15, in the middle with respect to the width direction. The dam 60 has a shape that surrounds the first drain port 15*b*, and includes a front plate portion 61, a rear plate portion 62, and a side plate portion 63. The front plate portion 61 of the dam 60 has a shape that connects to the left plate 15 and the bottom plate 11 and extends in the width direction of the pickling tank 10. The rear plate portion 62 of the dam 60 is connected to the left plate 15 and the bottom plate 11. The rear plate portion 62 of the dam 60 is disposed at a distance from the front plate portion 61, and has a shape that extends parallel to the front plate portion 61. The side plate portion 63 of the dam 60 has a shape that connects to an end portion of the front plate portion 61, an end portion of the rear plate portion 62, and the bottom plate 11, and extends in the traveling direction of the steel strip S. The upper end portion (inlet) 60*a* of the dam 60 is preferably disposed in a range below the traveling height h of the steel strip S inside the pickling tank 10, and above the ⅓ height of the liquid level La of the acid solution L during pickling operation. More preferably, the upper end portion 60*a* of the dam 60 is disposed in a range below the bottom plate portion 22*a* of the gutter-shaped member 22 and above the ½ height of the liquid level La of the acid solution L during pickling operation. In this way, during pickling pause, it is possible to heat the acid solution L with the heat exchangers 18 efficiently, while suppressing a discharge amount of the acid solution L from the pickling tank 10. Furthermore, it is possible to switch between pickling operation and pickling pause in a small amount of time. In other words, the dam 60 forms an inflow passage connecting to the first drain port 15*b*, and forms a part of a liquid-level adjustment unit configured to adjust and maintain the liquid level Lb of the acid solution L to be below the traveling height h of the steel strip S by allowing the acid solution L to flow over the upper end portion 60*a*. It should be noted that the inflow passage may be disposed outside the pickling tank 10, with the inlet connected to the left plate 15 of the pickling tank 10.

Preferably, the dam 60 and the pickling tank 10 are made of the same material. If the pickling tank 10 is made of a resin, the dam 60 may be preferably made of the same resin as the pickling tank 10. In this way, the dam 60 can expand thermally along with the pickling tank 10, which holds the acid solution L having a high temperature (e.g. 85 to 90° C.) during pickling operation and pickling pause. If the pickling tank 10 and the dam 60 are made of different materials, there is an increased risk of breakage occurring due to difference in the thermal expansion at joints between the pickling tank 10 and the dam 60.

The control device 50 is a device for controlling each component of the pickling device 100. The output side of the control device 50 is connected to the heat exchangers 18, the opening-and-closing valves 41*a*, 42*a*, and the circulation pump 44*a*, and is configured to be capable of controlling these components.

The main operation of the above described pickling device 100 will be described below.

During pickling operation, the control device 50 controls the heat exchangers 18 so as to heat the acid solution L to a predetermined temperature (e.g. 85 to 90° C.), and controls the acid-solution circulation device 40 such that the acid solution L does not circulate. In other words, the control device 50 controls the opening-and-closing valves 41*a*, 42*a* disposed in the first and second drain pipes 41, 42 to be fully closed, and controls the circulation pump 44*a* to stop. Accordingly, inside the pickling tank 10, the acid solution L is heated to the predetermined temperature, and the liquid level La of the acid solution L is maintained at the substantially same level as the cover member bodies 25*a* of the cover members 25. Thus, the steel strip S undergoes the pickling process, by traveling through the acid solution L while being immersed in the acid solution L, guided by the immersion guide rolls 23 and the skids 24.

During pickling pause, in which pickling operation is stopped temporarily (e.g. from a couple of hours to one day), the control device 50 controls the heat exchangers 18 so as to heat the acid solution L to a predetermined temperature (e.g. 85 to 90° C.), and controls the acid-solution circulation device 40 so as to circulate the acid solution L. In other words, the control device 50 controls the opening-and-closing valve 42*a* disposed in the second drain pipe 42 to be fully closed, and controls the opening-and-closing valve 41*a* disposed in the first drain pipe 41 to be fully open. Accordingly, the acid solution L inside the pickling tank 10 flows over the upper end portion 60*a* of the dam 60 and passes through the inside of the dam 60 downward to reach the vicinity of the first drain port 15*b*, and then flows from the first drain port 15*b* through the first drain pipe 41 into the circulation tank 43, where the acid solution L is temporarily stored. The acid solution L inside the pickling tank 10 is discharged into the circulation tank 43 via the first drain pipe 41, such that the liquid level Lb of the acid solution L inside the pickling tank 10 becomes substantially flush with the upper end portion 60*a* of the dam 60. Then, the control device 50 controls the opening degree of the opening-and-closing valve 41*a*, and controls the circulation pump 44*a* to operate. Accordingly, the acid solution L stored temporarily inside the circulation tank 43 flows into the pickling tank 10 via the supply pipe 44 in response to operation of the circulation pump 44*a*. That is, the first drain pipe 41 and the supply pipe 44 form two flow passages through which the acid solution L flows between the pickling tank 10 and the circulation tank 43. Whether the acid solution L is substantially flush with the upper end portion 60*a* of the dam 60 may be determined on the basis of a signal from a liquid level sensor provided in advance, or on the basis of elapse of time that the acid solution L takes to reach the upper end portion 60*a* of the dam 60, the time being obtained in advance. Through design or adjustment to keep the flow volume (supply amount) of acid solution supplied to the pickling tank 10 with the circulation pump 44*a* below a flow volume (discharge amount) at which acid solution can flow out the pickling tank 10 over the dam 60, the liquid level of the acid solution L can be maintained at the same level as the upper end portion 60*a* of the dam 60.

Thus, during pickling pause, the liquid level Lb of the acid solution L inside the pickling tank 10 is lowered to the substantially same level as the upper end portion 60*a* of the dam 60, which is below the traveling height h of the steel strip S inside the pickling tank 10. In this state, the acid solution L is circulated by the acid-solution circulation device 40 between the pickling tank 10 and the circulation tank 43, and the circulating acid solution L is heated to the predetermined temperature by the heat exchangers 18 inside the pickling tank 10.

Thus, according to the present embodiment, during pickling pause, in which pickling of the steel strip S is temporarily stopped, the acid solution L circulates between the pickling tank 10 and the circulation tank 43 while the liquid level Lb of the acid solution L inside the pickling tank 10 is maintained to be below the traveling height h of the steel strip S, and thereby it is possible to prevent over-pickling of the steel strip S. Furthermore, the acid solution L is heated by the heat exchangers 18 to the predetermined temperature and is circulated by the acid-solution circulation device 40 between the pickling tank 10 and the circulation tank 43. Thus, as compared to a case in which the total volume of acid solution is discharged from the pickling tank and stored in a tank separate from the pickling tank, a smaller volume of the acid solution L is returned to the pickling tank 10, which makes it possible to prevent a temperature decrease of the acid solution due to storage of the acid solution in a separate tank, and to shorten the time required to switch between pickling operation and pickling pause.

The control device 50 is configured to control opening and closing of the opening-and-closing valve 41*a* and operation of the circulation pump 44*a*. Therefore, even though the configuration is simple, it is possible to prevent over-pickling of the steel strip S during pickling pause reliably, and to shorten the time required to switch between pickling operation and pickling pause.

The height of the dam 60 is set so that the acid solution L has a liquid level such that the heat exchangers 18 are partially immersed in the acid solution L so as to enable heating that is necessary to maintain the acid solution temperature. Accordingly, it is possible to heat the acid solution L inside the pickling tank 10 reliably with the heat exchangers 18.

The pickling tank 10 has a depth such that the upper edge of each heat exchanger 18 is arranged in the acid solution L at the substantially same level as the traveling height h of the steel strip S, and the pickling tank 10 is provided with the guide device 20 for guiding the steel strip S to travel at a predetermined height in the acid solution L when the steel strip S is pickled with the acid solution L in the pickling tank 10. Accordingly, it is possible to prevent over-pickling of the steel strip during pickling pause reliably and shorten the time required to switch between pickling operation and pickling pause, even though the configuration is simple, as compared to a case in which, during pickling pause, the guide device and the steel strip are lifted above the liquid level of the acid solution with a lifting device or the total volume of the acid solution in the pickling tank is transported to a separate tank.

Second Embodiment

Figure 4:
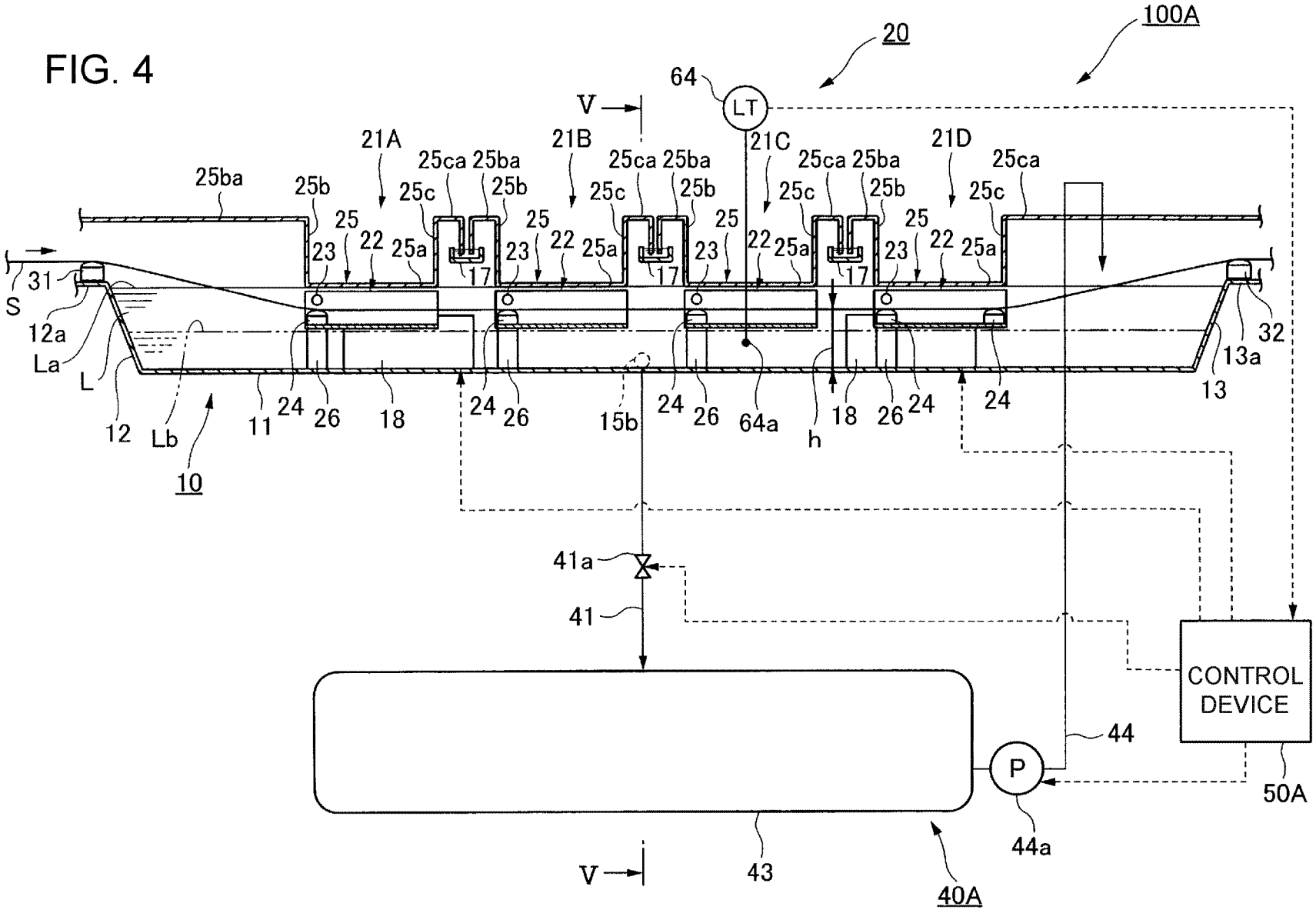
FIG. 4 is schematic side view of a pickling device according to the second embodiment of the present invention.
Figure 5:
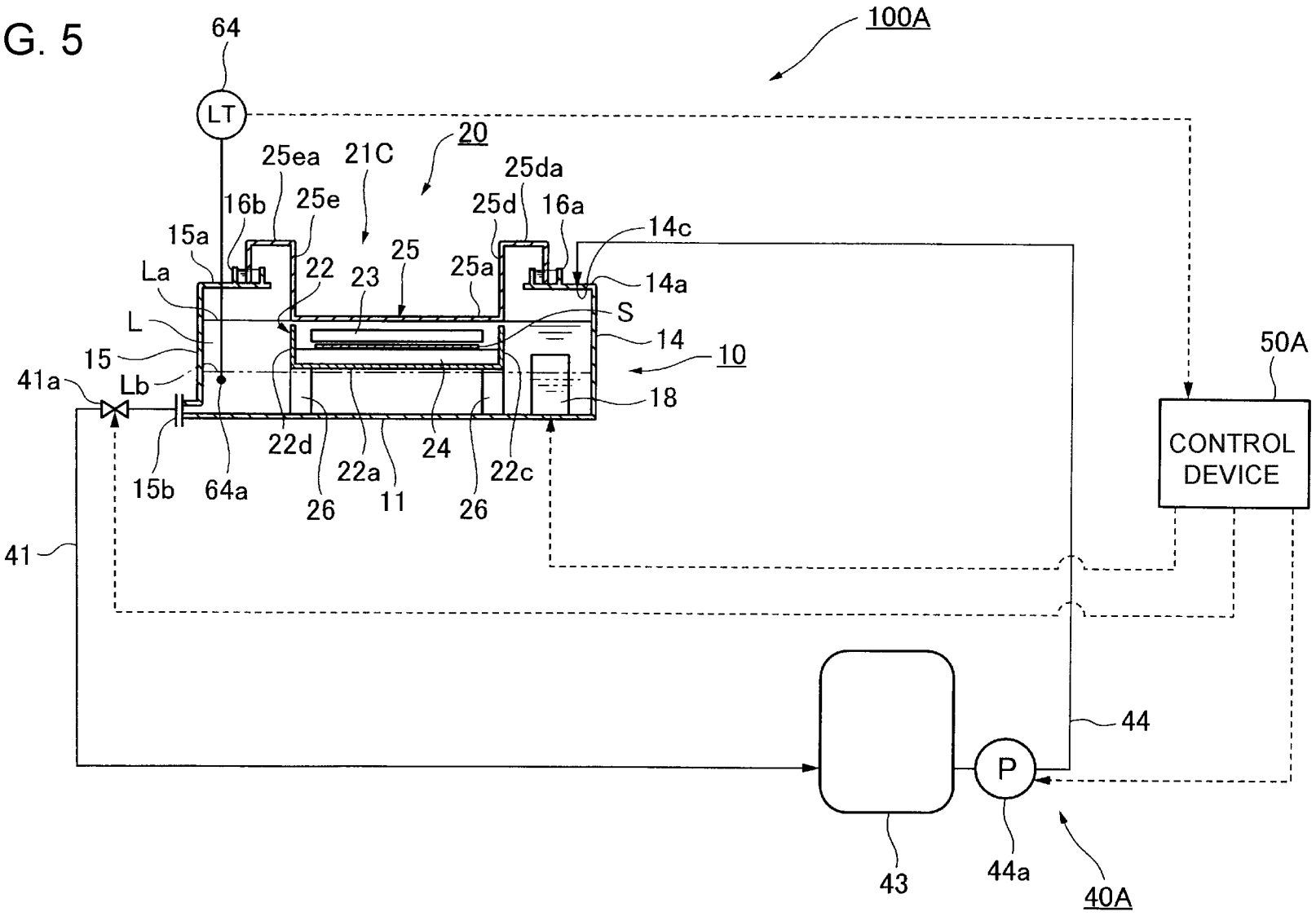
FIG. 5 is a cross-sectional view taken along line V-V in FIG. 4.

With reference to FIGS. 4 and 5, the pickling device according to the second embodiment of the present invention will now be described.

The present embodiment has a configuration in which the acid-solution circulation device and the control device provided for the above described first embodiment shown in FIGS. 1 and 2 are modified. The other configuration is similar to that of the above described device shown in FIGS. 1 and 2, and the same feature is indicated by the same reference numeral and not described again in detail.

As shown in FIGS. 4 and 5, a pickling device 100A according to the present embodiment includes the same devices as the pickling device 100 according to the above described first embodiment, as well as an acid-solution circulation device (acid-solution circulation unit) 40A, a liquid level sensor (liquid-level measurement unit) 64, and a control device (liquid-level adjustment unit) 50A. That is, the pickling device 100A includes a liquid level sensor 64 in place of the dam provided for the pickling device 100.

The acid-solution circulation device 40A includes a first drain pipe 41, an opening-and-closing valve 41*a*, a supply pipe 44, and a circulation pump 44*a*. In the present embodiment, the opening degree of the opening-and-closing valve 41*a* is controlled, and the timing for driving the circulation pump 44*a* is also controlled. Accordingly, the acid solution L inside the pickling tank 10 is fed into the pickling tank 10 via the first drain pipe 41, the circulation tank 43, and the supply pipe 44, and inside the pickling tank 10, the liquid level Lb of the acid solution L is maintained at a predetermined level, below the traveling height h of the steel strip S.

The liquid level sensor 64 is a device for detecting the liquid level of the acid solution L inside the pickling tank 10. The tip end portion 64*a* of the liquid level sensor 64 is positioned below the gutter-shaped member 22 of the guide device 20. The output side of the liquid level sensor 64 is connected to the control device 50A, and the liquid level sensor 64 detects the liquid level of the acid solution L inside the pickling tank 10 and sends information related to the liquid level of the acid solution L to the control device 50A.

The input side of the control device 50A is connected to the liquid level sensor 64. The output side of the control device 50A is connected to the heat exchangers 18, the opening-and-closing valve 41*a*, and the circulation pump 44*a*.

The main operation of the above described pickling device 100A will be described below.

During pickling operation, similarly to the control device 50 of the above described pickling device 100, the control device 50A controls the heat exchangers 18 so as to heat the acid solution L to a predetermined temperature (e.g. 85 to 90° C.), and controls the acid-solution circulation device 40A so as not to circulate the acid solution L. In other words, the control device 50A controls the opening-and-closing valve 41*a* disposed in the first drain pipe 41 to be fully closed, and controls the circulation pump 44*a* to stop. Accordingly, inside the pickling tank 10, the acid solution L is heated to the predetermined temperature, and the liquid level La of the acid solution L is maintained at the substantially same level as the cover member bodies 25*a* of the cover members 25. Thus, the steel strip S undergoes the pickling process, by traveling through the acid solution L while being immersed in the acid solution L, guided by the immersion guide rolls 23 and the skids 24.

During pickling pause, in which pickling operation is stopped temporarily (e.g. from a couple of hours to one day), the control device 50A controls the heat exchangers 18 so as to heat the acid solution L to a predetermined temperature (e.g. 85 to 90° C.), and controls the acid-solution circulation device 40A so as to circulate the acid solution L. In other words, the control device 50A controls the opening-and-closing valve 41*a* disposed in the first drain pipe 41 to be fully open. Accordingly, the acid solution L inside the pickling tank 10 flows from the first drain port 15*b* through the first drain pipe 41 into the circulation tank 43, in which the acid solution L is temporarily stored. Then, when the liquid level Lb of the acid solution L inside the pickling tank 10 detected by the liquid level sensor 64 is below the guide device bodies 21A to 21D, the control device 50A controls the opening degree of the opening-and-closing valve 41*a*, and controls the circulation pump 44*a* to operate. Accordingly, the acid solution L stored temporarily inside the circulation tank 43 flows into the pickling tank 10 via the supply pipe 44 in response to operation of the circulation pump 44*a*.

Accordingly, during pickling pause, the liquid level Lb of the acid solution L inside the pickling tank 10 is lowered to a level below the traveling height h of the steel strip S inside the pickling tank 10, and in this state, the acid solution L is circulated by the acid-solution circulation device 40A between the pickling tank 10 and the circulation tank 43, and the circulating acid solution L is heated to the predetermined temperature by the heat exchangers 18 inside the pickling tank 10.

Thus, according to the present embodiment, similarly to the above described first embodiment, during pickling pause, in which pickling of the steel strip S is temporarily stopped, the acid solution L circulates between the pickling tank 10 and the circulation tank 43 while the liquid level Lb of the acid solution L inside the pickling tank 10 is maintained to be below the traveling height h of the steel strip S, and thereby it is possible to prevent over-pickling of the steel strip S during pickling pause. Furthermore, the acid solution L is heated by the heat exchangers 18 to the predetermined temperature and is circulated between the pickling tank 10 and the circulation tank 43 by the acid-solution circulation device 40A. Thus, as compared to a case in which the total volume of acid solution is discharged from the pickling tank and stored in a tank separate from the pickling tank, a smaller volume of the acid solution L is returned to the pickling tank 10, which makes it possible to prevent a temperature decrease of the acid solution due to storage of the acid solution in a separate tank, and to shorten the time required to switch between pickling operation and pickling pause.

The control device 50A is configured to control opening and closing of the opening-and-closing valve 41*a* and operation of the circulation pump 44*a*. Therefore, even though the configuration is simple, the control device 50 can prevent over-pickling of the steel strip S during pickling pause reliably, and to shorten the time required to switch between pickling operation and pickling pause.

The control device 50A is configured to control opening and closing of the opening-and-closing valve 41*a* and operation of the circulation pump 44*a* on the basis of the liquid level of the acid solution L measured by the liquid level sensor 64. Therefore, even though the configuration is simple, the control device 50 can prevent over-pickling of the steel strip S during pickling pause more reliably, and to shorten the time required to switch between pickling operation and pickling pause.

Other Embodiments

While the above described pickling device 100 includes the dam 60 surrounding the first drain port 15*b* as an inflow passage of the liquid level adjustment unit, the pickling device may include an overflow pipe disposed in the pickling tank as an inflow passage of the liquid level adjustment unit, which connects to the first drain port of the pickling tank and has an inlet positioned below the traveling height of the steel strip. Also in such a pickling device, the acid solution overflows through the overflow pipe, and thereby it is possible to maintain the liquid level of the acid solution below the traveling height of the steel strip.

While the above described pickling device 100, 100A includes the guide device 20 having a plurality of guide device bodies with the gutter-shaped member 22 including the immersion guide roll 23 and the skid 24, arranged in the traveling direction of the steel strip S, the present invention may be applied to a pickling device provided with a support roll supporting the lower side of the steel strip so as to enable feeding of the steel strip.

While the above described pickling device 100, 100A includes the guide device 20 including four guide device bodies 21A to 21D, the number of guide device bodies is not limited to four, and may be three or less, or five or more, as long as the steel strip can be supported so as to be movable in the traveling direction of the steel strip while being immersed in the acid solution.

While the first drain port 15*b* and the second drain port 14*b* of the pickling tank 10 are connected to the first drain pipe 41 and the second drain pipe 42 and the supply port 14*c* of the pickling tank 10 is connected to the supply pipe 44 in the above described pickling tank 100, and the first drain port 15*b* of the pickling tank 10 is connected to the first drain pipe 41 and the supply port 14*c* of the pickling tank 10 is connected to the supply pipe 44 in the pickling device 100A, a flexible tube may be interposed between joints of the pickling tank and the drain pipe and the supply pipe. Accordingly, even if the pickling tank 10 thermally expands, the flexible tube can absorb thermal expansion of the pickling tank 10.

While the above described pickling device 100, 100A includes two heat exchangers 18 arranged next to one another in the traveling direction of the steel strip S in the vicinity of the right plate 14 of the pickling tank 10, the number of heat exchangers is not limited to two, and may be one, or three or more. The pickling device may include heat exchangers arranged only in the vicinity of the left plate 15 of the pickling tank 10, or on both sides in the vicinity of the right plate 14 and in the vicinity of the left plate 15 of the pickling tank 10.

While the above described pickling device 100, 100A includes the cover members 25 provided corresponding to the respective guide device bodies 21A to 21D, the pickling device may include a single cover member that covers the pickling tank 10 from above.

While the above described pickling device 100, 10A uses water seals to seal the end portions of the cover members 25, the pickling device may use rubber packing where rubber seals are attached to end portions of the cover members.

While the above described pickling device 100, 100A includes the heat exchangers 18, the pickling device may include a device capable of heating the acid solution L to a predetermined temperature, such as a heater, in place of the heat exchangers.

While the above described pickling device includes a pickling tank and a circulation tank disposed below the pickling tank, the arrangement of a pickling tank and a circulation tank is not limited to this. It is sufficient if the acid solution can be circulated between the pickling tank and the circulation tank by the acid-solution circulation device. A circulation tank may be disposed above a pickling tank, or a pickling tank and a circulation tank may be disposed at the same level. Furthermore, while the above described acid-solution circulation device 40, 40A includes the opening-and-closing valve 41*a* disposed in the first drain pipe 41, and the circulation pump 44*a* disposed in the supply pipe 44, it is sufficient if the acid solution can be circulated between the pickling tank and the acid-solution circulation tank. The acid-solution circulation device may include pumps disposed in both of the drain pipe and the supply pipe, or may include pumps and opening-and-closing valves disposed in both of the drain pipe and the supply pipe, or may include a pump disposed in the drain pipe and an opening-and-closing valve disposed in the supply pipe.

INDUSTRIAL APPLICABILITY

According to the present invention, it is possible to prevent over-pickling of a steel strip during pickling pause and reduce the switching time between pickling operation and pickling pause. Thus, the present invention can be beneficially utilized in the metal manufacturing industry, for instance.

DESCRIPTION OF REFERENCE NUMERALS

1 Pickling tank
11 Bottom plate

14 Right plate
14*b* Second drain port
14*c* Supply port
15 Left plate
15*b* First drain port
16*a* Right receiving portion
16*b* Left receiving portion
17 Width-directional receiving portion
18 Heat exchanger
20 Guide device
21A to 21D Guide device body
22 Gutter-shaped member
23 Immersion guide roll
24 Skid
25 Cover member
26 Support block
31, 32 Inlet skid
40, 40A Acid-solution circulation device
41 First drain pipe
41*a* Opening-and-closing valve
42 Second drain pipe
42*a* Opening-and-closing valve
43 Circulation tank (Acid-solution storage tank)
44 Supply pipe
44*a* Circulation pump
50, 50A Control device (Liquid-level adjustment unit)
60 Dam
60*a* Upper end portion
64 Liquid level sensor (liquid-level measurement unit)
64*a* Tip end portion
100, 100A Pickling device
h Traveling height of steel strip
L Acid solution
La Liquid level (during pickling operation)
Lb Liquid level (during pickling pause)
S Steel strip

The invention claimed is:

1. A pickling device, comprising:

a pickling tank for storing acid solution and for pickling a steel strip by allowing the steel strip to travel therethrough while the steel strip is immersed in the acid solution;

a heating unit for heating the acid solution in the pickling tank;

an acid-solution storage tank for storing the acid solution, provided separately from the pickling tank;

an acid-solution circulation unit configured to circulate the acid solution between the pickling tank and the acid-solution storage tank; and a liquid level adjustment unit configured to control the acid-solution circulation unit to maintain a liquid level of the acid solution in the pickling tank at a level below a traveling height of the steel strip, wherein the liquid-level adjustment unit includes an inflow passage which connects to a drain port for the acid solution disposed on the pickling tank, wherein the inflow passage has an inlet positioned below the traveling height of the steel strip and above the drain port, and wherein the liquid-level adjustment unit is configured to allow the acid solution in the pickling tank to overflow from the inlet to maintain the liquid level of the acid solution in the pickling tank at the level of the inlet, wherein the inflow passage is a dam which surrounds the drain port for the acid solution.

2. The pickling device according to claim 1, wherein the acid-solution circulation unit includes a flow passage between a drain port of the pickling tank and the acid-solution storage tank, a flow passage between a supply port of the pickling tank and the acid-solution storage tank, an opening-and-closing valve disposed in at least one of the two flow passages, and a pump disposed in at least the other one of the two flow passages, and wherein the liquid-level adjustment unit is configured to control opening and closing of the opening-and-closing valve and operation of the pump.

3. The pickling device according to claim 1, wherein the heating unit is a heat exchanger, and wherein the liquid-level adjustment unit is configured to adjust a liquid level of the acid solution so that at least a part of the heat exchanger is immersed in the acid solution.

4. A pickling device, comprising:

a pickling tank for storing acid solution and for pickling a steel strip by allowing the steel strip to travel therethrough while the steel strip is immersed in the acid solution;

a heating unit for heating the acid solution in the pickling tank;

an acid-solution storage tank for storing the acid solution, provided separately from the pickling tank;

an acid-solution circulation unit configured to circulate the acid solution between the pickling tank and the acid-solution storage tank; and a liquid level adjustment unit configured to control the acid-solution circulation unit to maintain a liquid level of the acid solution in the pickling tank at a level below a traveling height of the steel strip, wherein the acid-solution circulation unit includes a flow passage between a drain port of the pickling tank and the acid-solution storage tank, a flow passage between a supply port of the pickling tank and the acid-solution storage tank, an opening-and-closing valve disposed in at least one of the two flow passages, and a pump disposed in at least the other one of the two flow passages, wherein the liquid-level adjustment unit is configured to control opening and closing of the opening-and-closing valve and operation of the pump, and wherein the liquid-level adjustment unit includes a liquid-level measurement unit for measuring a liquid level of the acid solution, and is configured to control opening and closing of the opening-and-closing valve and operation of the pump on the basis of the liquid level of the acid solution measured by the liquid-level measurement unit.

5. A method of operating, during pickling pause, a pickling device which comprises: a pickling tank for pickling a steel strip by allowing the steel strip to travel therethrough while the steel strip is immersed in acid solution; a heating unit for heating the acid solution in the pickling tank; a circulation unit configured to circulate the acid solution between an acid-solution storage tank for storing the acid solution and the pickling tank; and a liquid level adjustment unit configured to control the acid-solution circulation unit to adjust a liquid level of the acid solution in the pickling tank, the liquid-level adjustment unit including an inflow passage which connects to a drain port for the acid solution disposed on the pickling tank, the inflow passage being a dam which surrounds the drain port for the acid solution and having an inlet positioned below a traveling height of the steel strip and above the drain port, the method comprising:

during pickling pause of the steel strip, circulating the acid solution between the acid-solution storage tank and the pickling tank with the circulation unit while maintaining a liquid level of the acid solution inside the pickling tank at a level of the inlet by allowing the acid solution in the pickling tank to overflow from the inlet by means of the liquid level adjustment unit, and heating the circulating acid solution with the heating unit inside the pickling tank.

* * * * *